US005181345A

United States Patent [19]

Kulan

[11] Patent Number: 5,181,345

[45] Date of Patent: Jan. 26, 1993

[54] LENS GRINDING METHOD AND APPARATUS

[75] Inventor: Stephen Kulan, Gibson, Okla.

[73] Assignee: Coburn Optical Industries, Inc., Tulsa, Okla.

[21] Appl. No.: 899,131

[22] Filed: Jun. 16, 1992

Related U.S. Application Data

[63] Continuation of Ser. No. 510,834, Apr. 18, 1990, abandoned.

[51] Int. Cl.[5] ..... B24B 49/02; B24B 51/00

[52] U.S. Cl. ..... 51/165.77; 51/165.71; 51/105 LG; 51/124 L

[58] Field of Search ..... 51/105 LG, 106 LG, 126, 51/124 L, 165.77, 165.71, 165.74, 165.75, 165.76, 284 R

[56] References Cited

U.S. PATENT DOCUMENTS

| | | | |
|---|---|---|---|
| 2,806,327 | 9/1957 | Coburn . | |
| 3,289,355 | 12/1966 | Coburn et al. . | |
| 3,492,764 | 2/1970 | Dalton | 51/124 L X |
| 3,900,971 | 8/1975 | Brueck | 51/124 L X |
| 4,178,720 | 12/1979 | Hashimoto | 51/124 L |
| 4,535,566 | 8/1985 | Soper et al. . | |
| 4,535,666 | 8/1985 | Fiori et al. . | |
| 4,908,997 | 3/1990 | Field, Jr. et al. | 51/105 LG |
| 4,947,715 | 8/1990 | Council, Jr. | 51/124 L X |

FOREIGN PATENT DOCUMENTS

| | | |
|---|---|---|
| 0176894 | 4/1986 | European Pat. Off. . |
| 60-114457 | 6/1985 | Japan . |

*Primary Examiner*—D. S. Meislin

*Attorney, Agent, or Firm*—Burns, Doane, Swecker & Mathis

[57] ABSTRACT

A lens grinding apparatus is capable of generating, in a lens blank, a power curve less than three diopters and having both a base characteristic and a cross curve characteristic. A plate is pivotably mounted on a base means, a first slide is slidably mounted on the plate, a second slide is pivotably mounted on the first slide, and a tool is mounted on the second slide for rotation about a tool axis of rotation. During a sweep of the tool across a lens blank, the position of the tool relative to the lens blank is continuously sensed to control a micro-processor. Under the control of the micro-processor, the first slide is continuously slid along the plate, and the second slide is continuously pivoted about an axis relative to the first slide. This is performed so that the sweep radius and the real head angle of the tool are continually changed in a manner maintaining a constant radius of curvature of the curve, and a constant effective head angle of the tool.

2 Claims, 4 Drawing Sheets

LENS GRINDING METHOD AND APPARATUS

This application is a continuation of application Ser. No. 07/510,834, filed Apr. 18, 1990 now abandoned.

FIELD OF THE INVENTION

The present invention relates to a method and apparatus for generating ophthalmic spherical and spherocylindrical lenses, and more particularly to the generation of ophthalmic lenses with base curves in the range from zero dioptres to at least twenty dioptres.

BACKGROUND AND OBJECTS OF THE INVENTION

The traditional technique for making ophthalmic lenses involves repeated grinding passes usually known as sweeps across a lens blank with a cutting tool, which is usually a circular cup shaped diamond tool. The sweeps are continued until the blank has been shaped to the desired surface curvature and lens centre thickness. The range of curvatures produced by available conventional lens grinding machines in the spherical meridian is in the range from 3 to 20 dioptres. It is desirable to extend that range down to zero dioptres i.e. lenses with no curvature in the spherical meridian. The extension of the range of lens grinding machines has been the subject of previous proposals e.g. U.S. Pat. No. 4,535,566 describes a mechanical system in which the locus of the grinding wheel can be varied to extend the range of the system. The basis of this proposal is to use a cam follower mechanism to radially reposition the diamond tool as it is swept over the lens blank surface. The change in the sweep radius length while sweeping simulates a particular radius of curvature. The operations described in U.S. Pat. No. 4,535,566 required a designated cam surface (or template) for every specific base curve it is desired to generate. U.S. Pat. No. 4,535,566 maintains the same head angle, i.e. the angle at which the tool head is set to a tangent to the curve being cut throughout the sweep by means of a complex four bar linkage which must be adjusted according to the desired prescription before the lens generation process begins. Thus this prior proposal provides a lens grinding machine which while having an extended range, is only adjustable to produce selected curves within that range, and requires a skilled operator to set the machine up for a particular power.

An object of the present invention is to produce a lens grinding machine and a lens generating method which can be operated with limited operator attention and the use of relatively unskilled operators in that no complex setting up procedures are required by utilising numerical control procedures. It is a further object to produce a machine with an extended range, which can be produced by relatively modest machine modifications to existing designs.

SUMMARY OF THE INVENTION

A method according to the invention for generating a lens having desired base and cross curvatures, which are the same in the case of a spherical lens, by means of a circular cup shaped diamond tool, comprises the diamond tool being swept repeatedly over a lens blank to remove material so as to generate the required surface and being positioned so as to produce the desired combination of base and cross curvatures on the blank, the diamond tool being positioned by means of two slides, a cross slide, and a base slide, both slides being free to move during the generation of the surface, the diamond tool rotating about an axis generally perpendicular to the axis of the lens, and being adjusted to a specific head angle by means of the cross slide so as to produce the desired cross curvature, the diamond tool being further positioned by means of the base slide to produce the desired base curvature, the head angle being varied during the sweep and its value monitored and maintained in response to such monitoring at such an angle at any position in the sweep by adjustment of the relative positions of the cross and base slides such that the "effective" head angle at which the tool must be set to cut the desired cross curvature is maintained constant.

In the operation of a conventional lens grinding machine, the head angle is fixed during the sweep by clamping the cross slide. The head angle has previously been selected and the adjustment of the cross slide already made prior to clamping. The base slide is then positioned so that the tool edge is the radius of the prescription base curve away from the axis about which the tool is swept. The lens blank is then moved toward the tool so that the finished lens will have a pre-determined lens thickness when the sweeping action is completed. Lens and tool are stepped toward each other as the sweeping action progresses so that a constant amount of material is removed at each sweep.

In the method of the present invention, an additional degree of motion is provided which enables an extended range of curves to be generated. This is achieved by clamping neither the cross slide nor the base slide in a fixed position during the shaping of the lens blank. The cross slide is simply positioned at an initial head angle, and the base slide at an initial distance from the sweep axis. The base slide position when operating the machine in the range feasible in the prior art mode is fixed at a distance away from the sweep pivotal axis equal to the base curve radius. Operating in the range 0–3 dioptres, the base slide is positioned at a known reference radius, measured at the centre of the lens, from the sweep pivotal axis, e.g. 170 mm and this reference radius can extend or retract by a particular amount when the base slide is moved away or toward the lens centre so as to produce the desired base curve. In the case of a 170 mm reference radius, the base slide position can change 6 mm up to 176 mm for an 80 mm diameter lens.

As regards the position of the cross slide, if this is positioned so that the diamond tool is at the lens centre, the tool will be at the desired base radius from the sweep pivotal axis, and the real head angle of the diamond tool is at the angle required to generate the desired cross curve, and the sweep angle will be zero.

As the tool moves away from the lens centre, and the sweep angle increases, in order to maintain the tool in the correct generating position, the base slide must extend out to enable the tool to move along the path of the desired base curve. The head angle of the diamond tool must be adjusted so that at any particular point during the sweep the angle, which the diamond tool makes relative to the desired surface, is held to a constant value equal to the head angle when the sweep angle was at zero. This results in the tool angle being effectively the angle which results in the required cross curve being generated, referred to here as the "effective" head angle.

In order to carry out the above operations, it is therefore necessary to constantly sample the sweep angle during the sweep and adjust the base and cross slide positions in relation to the position of the tool in its sweep so as to maintain the tool at the desired effective head angle to generate the required cross curve, and the desired distance from the sweep pivotal axis to produce the required base curve. The machine must therefore be provided with means to determine the sweep angle, and the base slide must be mounted so as to be able to be positioned at a constantly changing distance from the pivotal sweep axis.

BRIEF DESCRIPTION OF THE DRAWINGS

FIG. 2(*b*) is a diagrammatic front view of a lens generating machine according to the invention.

FIG. 3(*b*) is a diagrammatic view showing the path followed by the diamond tool to generate the desired base curve.

Figure 1:
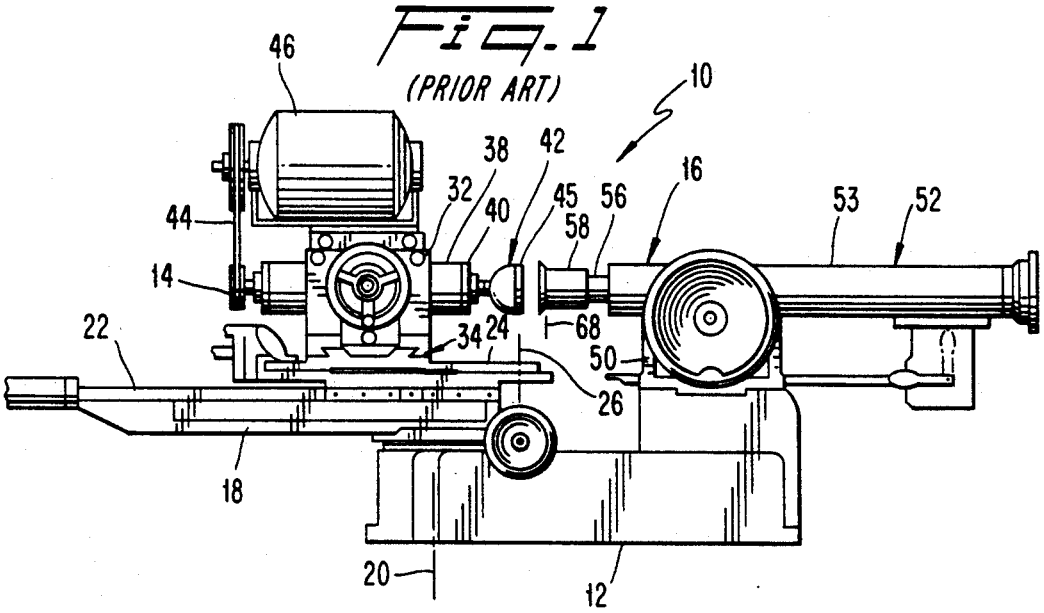
Fig. 1 (PRIOR ART)
FIG. 1 is an elevation of a known form of lens generating machine.

Referring first to FIG. 1, a lens curve generating machine 10 comprises a base 12 on which are mounted a tool supporting mechanism 14 and a lens supporting mechanism 16. The tool supporting mechanism is similar to that described in U.S. Pat. Nos. 2,806,327 and 3,289,355, the disclosures of which are incorporated by reference herein. Basically, the tool supporting mechanism 14 comprises a plate 18 which is pivotably mounted to the base 12 for rotation about a vertical axis 20. Slidably mounted on a horizontal surface of the plate 18 is a tool support comprising a base curve slide 22, and a cross curve slide 24 pivotably mounted to the base curve slide for rotation about a vertical axis 26 defined by a pin 27. The base curve slide can be adjusted horizontally relative to the plate 18 in a fore-to-aft direction toward and away from the lens supporting mechanism. The cross curve slide 24 can be adjusted relative to the base curve slide 22 about the axis 26.

Mounted on the cross curve slide 24 is a bearing block 32 which is adapted to slide horizontally relative to the cross curve slide in a direction perpendicular to the fore-to-aft direction. This is achieved by mounting the bearing block 32 by means of a dove-tail track 34 and providing a conventional adjustment means.

A spindle housing 38 mounted in the bearing block 32 rotatably carries a shaft 40 on one end of which a grinding tool 42 is supported. The opposite end of the shaft is driven by a belt drive 44 from a motor 46 resting atop the bearing block.

The tool 42 is cup-shaped and presents a curved cutting edge 45. The curved edge is rounded as viewed in cross-section so as to define a centre of curvature spaced from the plane of the curved edge. The arrangement of the bearing block and spindle housing is such that the vertical axis 26 is intersected by that centre of curvature during each grinding sweep of the tool. The axis 26 thus defines a tool reference axis. The grinding sweep of the tool is effected by oscillating the tool supporting mechanism 14 about the vertical axis 20 after the tool 42 has been properly positioned throughout appropriate adjustments of the base slide 22 and cross side 24.

The lens supporting mechanism 16 comprises a support block 50 on which a tailstock assembly 52 is slidably supported. The tailstock 52 includes a housing 53 which can be reciprocated in a horizontal fore-to-aft direction by conventional means. A shaft 56 is mounted in the tailstock for reciprocable movement relative to the housing 53 in the fore-to-aft direction. A front end of the shaft 56 carries a lens holder in the form of a conventional chuck 58. The chuck includes a space ring with a lens blank inserted so that a so-called "front curve" of the lens abuts against a front surface of the space ring. That surface defines a vertical lens reference plane 68 disposed perpendicular to the fore-to-aft direction of movement of the shaft 56 and parallel to the tool reference axis 26.

The operation of this machine to generate a particular base and cross curve will now be described. The cross slide 24 is moved to a position at which the head of the diamond tool will be at the head angle necessary to generate the desired cross curve. The cross slide 24 is then clamped in that position. The base slide 22 is then moved to a position such that the tool edge is the radius of the desired prescription curve away from the sweep axis, and the base slide is then clamped in position. The tailstock assembly 52 carrying the lens blank on which the curves are to be generated is then moved to a position such that the lens blank will be reduced to the desired lens centre thickness once the curve generation has been completed. The tailstock slide is then clamped in position and first sweep is commenced. Between each sweep, the relative axial positions of the lens and diamond tool are adjusted so that the diamond tool contacts the blank to remove a further layer of the surface on each sweep until the desired lens thickness is achieved. The lens may then be removed for the further operations necessary to convert it into its final form for filling in frames which comprises at least fining, polishing, and edging, but can also include tinting and coating with such coatings as abrasion-resistant and anti-reflection coatings.

Figure 2A:
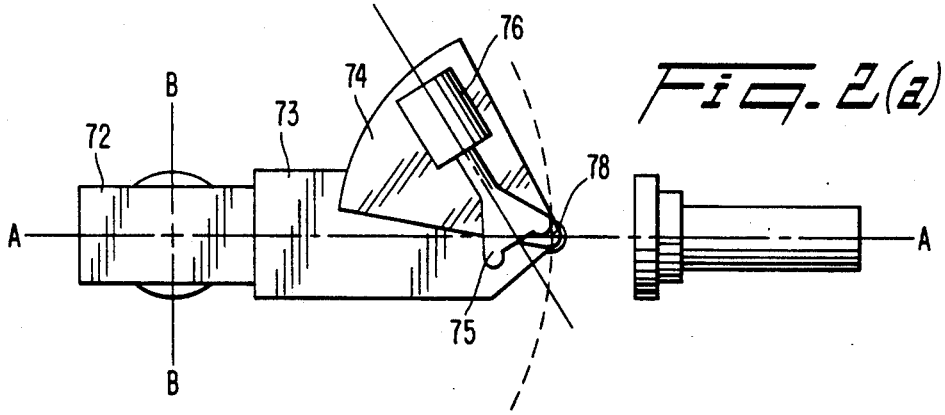
FIG. 2(*a*) is a diagrammatic top view of a lens generating machine according to the invention.
Figure 2B:
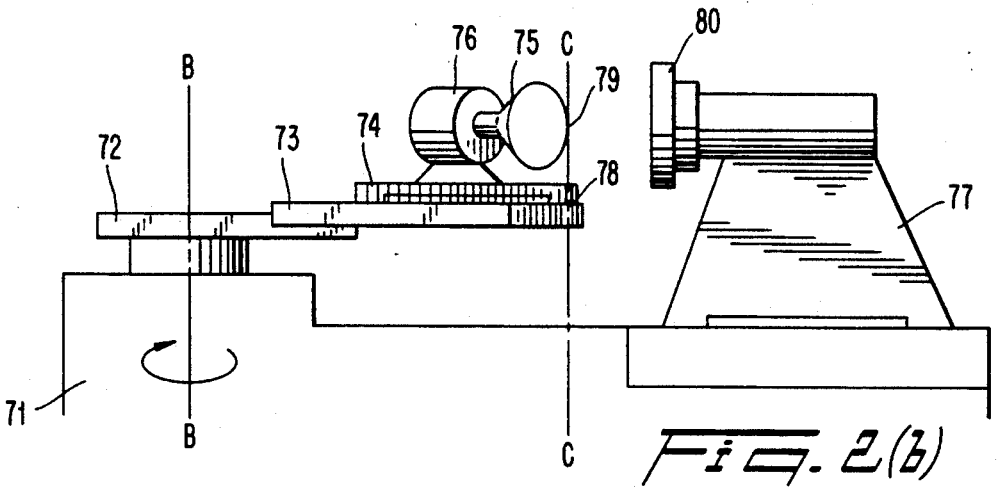
Figure 3A:
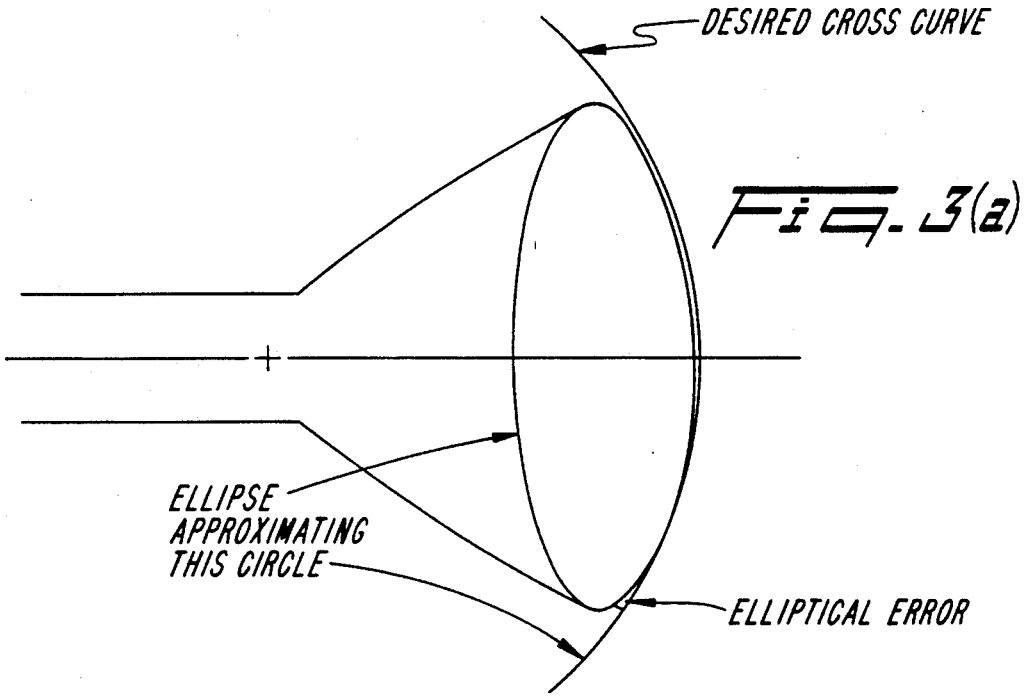
FIG. 3(*a*) is a diagrammatic view of how the desired cross curve is cut by the diamond tool.
Figure 3B:
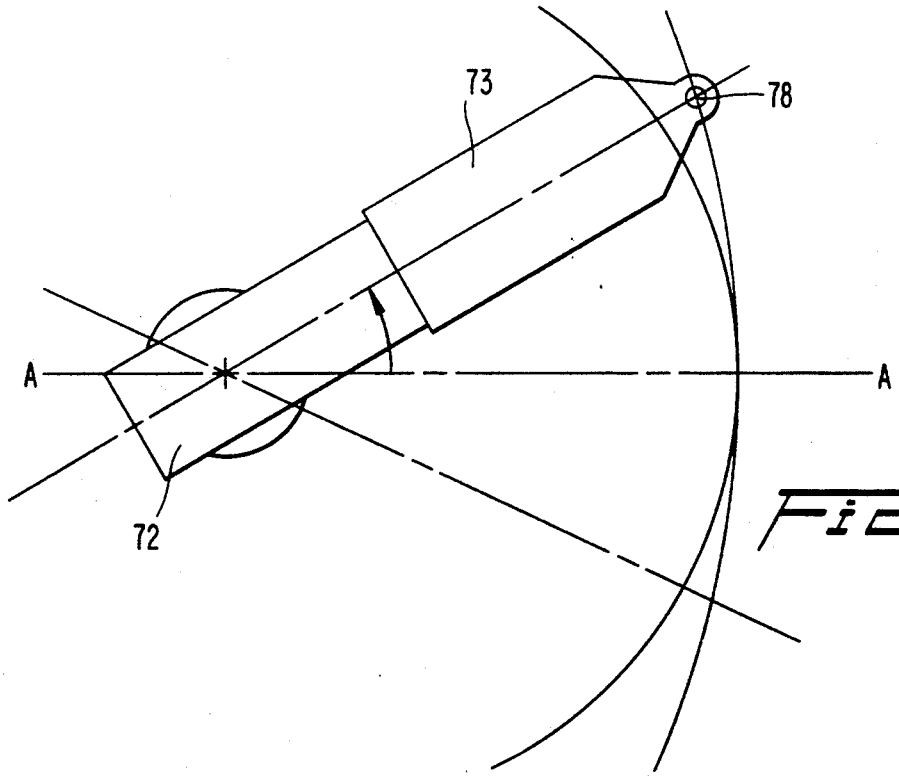

Referring now to FIGS. 2 and 3, in the lens generating machine of the present invention, in order to enable the machine to not only generate lenses in the curve range 3 to 20 dioptres but additionally lenses with curves ranging from zero dioptres up to 3 dioptres, two features are required in addition to those conventionally available on a lens grinding machine designed to produce lenses with curves in the range 3 to 20 dioptres. The hydraulic cylinder which positions the cross slide must be able to accommodate the increased travel required to enable the additional range of powers to be achieved, and the slide bearing surfaces extended to accommodate the additional travel of the cylinder. Existing machines are available whose design can be simply modified, e.g. the machine sold by Coburn Optical Inc. under the trade name "Coburn Model 2112 generator". The amount of change and additional equipment required depends on the sophistication of the original design, e.g. a hand operated machine would require not only the slide bearing surfaces to be modified but also the addition of powered motion with their associated servo-mechanisms, encoders, and motion control cards with their associated micro-processor equipment. It is essential that an encoder is present on the sweep mechanism to allow the sweep angle to be measured, i.e. the angle that the base slide makes with the machine centre. line. The latter is the line joining the point about which the base slide is pivoted (the sweep pivot) and the lens centre. This measurement is then used as shown in the flow chart FIG. 5 as input to the micro-processor so that the necessary adjustments to be made to the cross-slide can be calculated and if necessary to the base slide to maintain the head angle at the value to give an effective head angle at which the required cross curve will be produced.

The conversion of the signal received from the encoder to a signal to control the mechanical adjustment of the position of both the base slide and the cross slide, and the use of that signal is carried out in a manner well known to those skilled in the art of servo controlled motion mechanisms.

The parts shown in the diagrammatic view in FIG. 2 are those whose motion is controlled during the operation of the machine. The machine has a base 71 on which there is mounted a sweep platform 72, on which in turn there is mounted a base slide 73, on which the cross slide 74 carrying a diamond tool 75 driven by a motor 76 is mounted. A lens blank supporting mechanism 77 is mounted on the base 71 and the position of the lens blank 80 can be adjusted along an axis A—A in relation to the diamond tool 75. Axis B—B is the sweep axis about which the sweep platform 72 pivots when driven by a hydraulic cylinder (not shown) so that the pivot point 78 is at a distance equal to a desired base curve radius from the sweep axis B—B. The cross slide 74 can be pivoted about the pivot point 78 through which a vertical line C—C passes and which line also passes along the cutting edge 79 of the diamond tool. The diamond tool is then at a head angle to the curve being cut. The head of the diamond tool is of a circular cup shape so that at any head angle other than zero, the result is that the circle is effectively projected as an ellipse when considered in front view. It is a portion of this ellipse which grinds through the lens blank. FIG. 3 shows how the ellipse approximates to a circle of the desired radius with a so-called elliptical error occurring at the edges. The lens blank 80 is moved along with its supporting mechanism 77 to a position such that at the end of the necessary number of sweeps across the lens surface, the lens has a chosen lens thickness as well as the desired surface shape.

FIG. 3(*b*) shows the base slide 73 positioned on the sweep platform 72 at the start position of the sweep. The angle of the axis of these two components which passes through the sweep axis and the pivot point 78 with the axis passing through the lens centre being the sweep angle. The sweep about the sweep axis is from this start position to the reciprocal position on the other side of the axis A—A.

Figure 4:
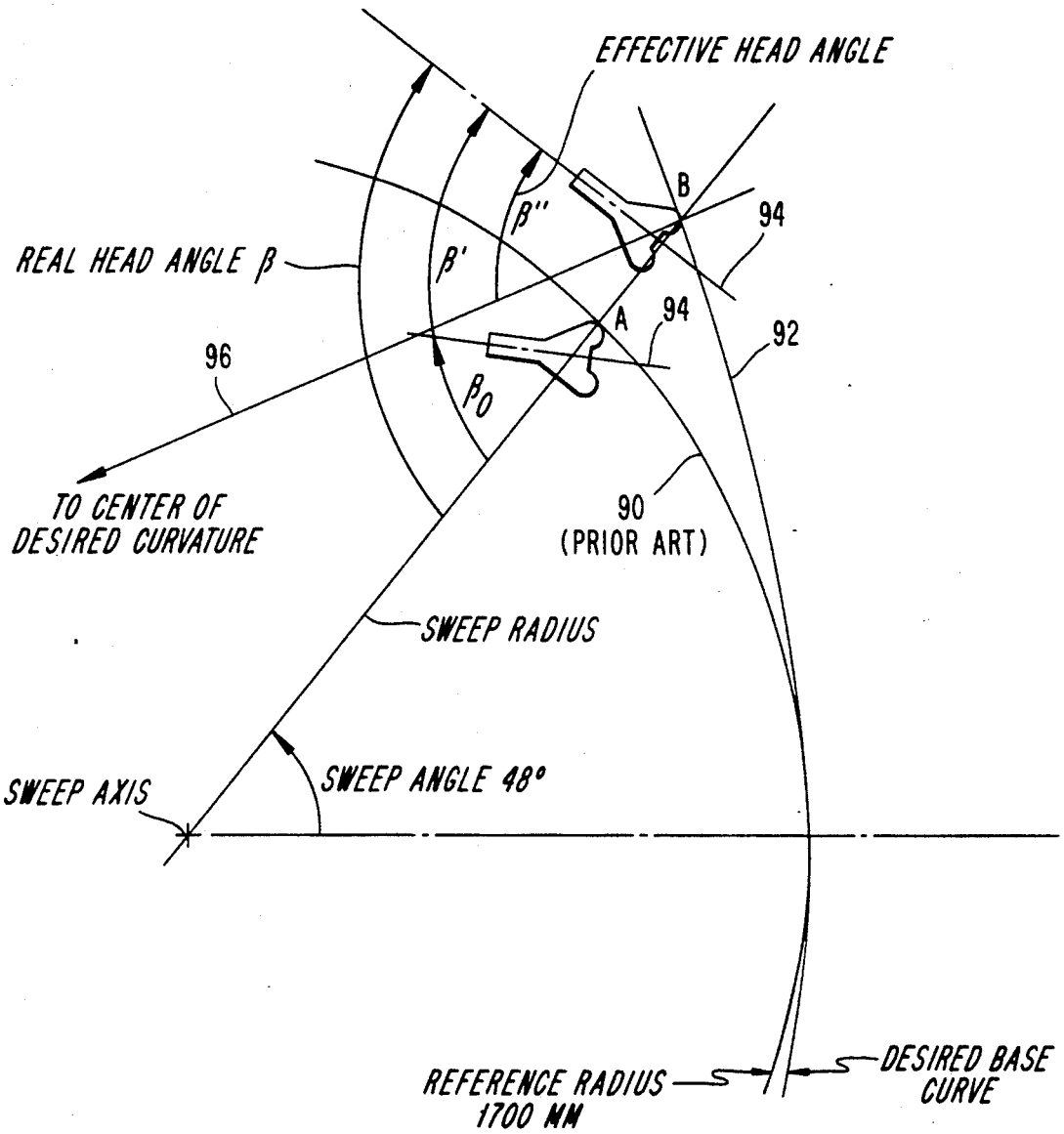
FIG. 4 is a diagrammatic view of the relationship between the corrected head angle $\beta$ which is kept constant throughout the sweep, $\beta o$ the head angle to produce a reference base radius curve, $\beta'$ the adjustment to $\beta o$ to achieve a setting at the head angle $\beta$, and $\beta''$ the head angle made with the desired curve.

FIG. 4 shows the relationship between the unadjusted (prior art) head angle at location A, and the adjusted head angle at location B according to the present invention which is achieved with a specific cross slide movement for a particular point in the sweep, i.e. the real time value of the sweep angle.

In order to manufacture a lens with a base curve 90 greater than 3 dioptres, the diamond tool is moved to its initial position at say a sweep angle of 48°. The base slide is set so that the radius of the sweep would be 170 mm. plus some calculated amount to position the diamond on the desired curve The cross slide is then piveted to a position such that the the angle which the diamond makes relative to the desired base curve is equal to a value calculated using the reference radius of 170 mm and a sweep angle of zero degrees to achieve a desired cross curve characteristic. This value is a constant for any desired base curve. The diamond tool is then in the position shown as A. In order to put the diamond tool in the correct position for generating the desired base curve 92 of less than 3 dioptres as shown, the base slide must be extended to position B, and the diamond tool rotated by a head angle adjustment $\beta'$ so that the angle $\beta''$ is equal to the above constant for the desired base curve 92. Then:

$$\beta' + \beta o = \beta$$

$\beta$is then the real or corrected head angle, and $\beta''$ is the effective head angle which is to be held constant during a sweep. That effective head angle is formed between the tool axis of rotation 94 and the radius of curvature 96 of the curve 92.

As the sweep angle decreases, the base slide will retract until it reaches the lens centre, after which it will extend. The effective head angle adjustment required to maintain the effective head angle constant will diminish to zero as the lens centre is reached, as at that point no correction to $\beta o$ is needed. After reaching the lens centre, the base slide extends, and the head angle adjustment increases.

Figure 5:
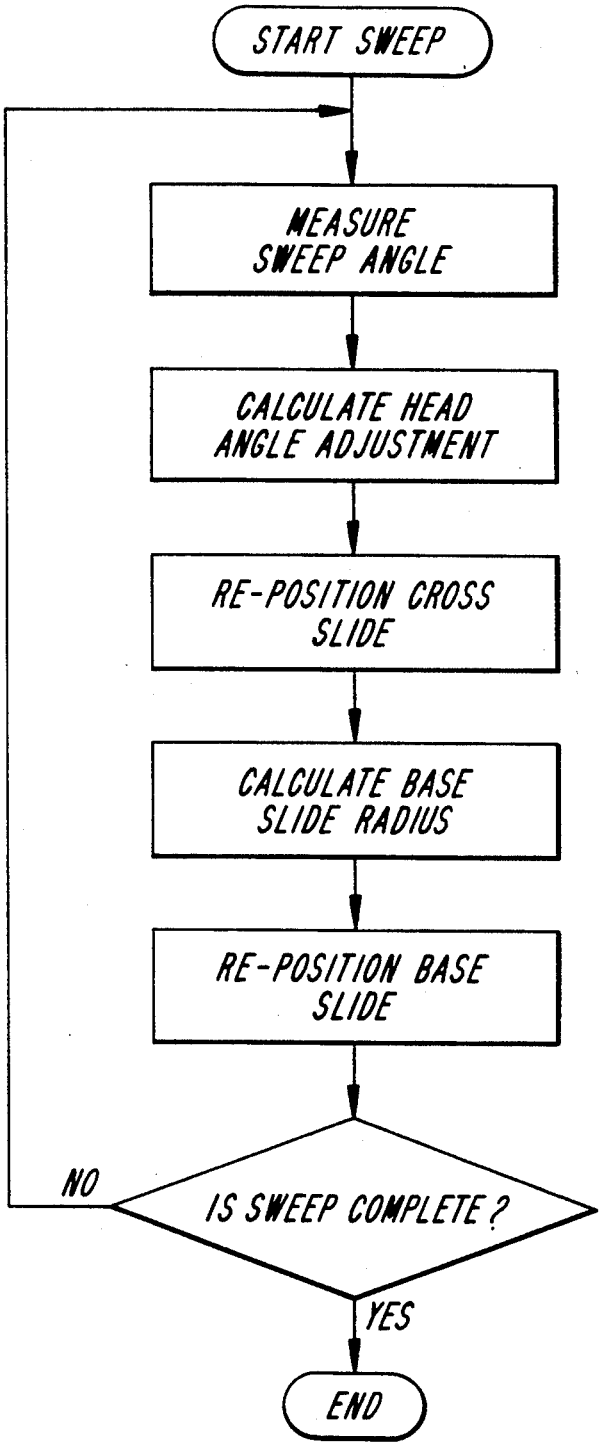
FIG. 5 is a flow chart showing the operations performed during each sweep in order to maintain the head angle necessary to generate the desired cross curve, and the base slide position to achieve the desired base curve.

Referring to the flow chart FIG. 5, the sequence of operations will now be described in more detail. During the sweep across the lens blank from the start position to the end of the sweep, the angle of sweep i.e. the angle to which the sweep platform 71 is pivoted, is sensed by means of a rotary encoder. The signal from the encoder is processed and the adjustment of the real head angle $\beta$ of the cross slide needed to maintain the effective head angle $\beta''$ at the constant value is determined. The base slide radius is then determined, and the signal processed so that the base slide may be positioned so as to maintain the sweep along the desired base curve. The process is then repeated until the sweep is complete, and when the sweep is complete, the distance between the lens blank and the tool path is reduced by a pre-determined amount and the next sweep commenced to remove further material and reduce lens thickness. The microprocessor used for these determinations, and the necessary electro-mechanical equipment to carry out the necessary adjustments are both conventional.

This method of operating a lens generating machine enables the range of the machine to be extended below 3 dioptres. The machine can of course be operated in the range from 3 to 20 dioptres and when operating in that range, the base slide position does not alter during the generation of the lens curvature.

Our invention also includes a lens generating machine capable of generating curves in the range 0 to 20 dioptres, which comprises a base slide mounted so as to be extendable to base curve radii necessary to generate lenses throughout the power range, and a cross slide on which there is mounted a diamond tool whose head angle is adjusted such that as the tool is swept past a lens blank to generate a lens with a desired power, the effective head angle to generate the desired cross curve is maintained constant, and means to monitor the sweep position of the tool, and adjust the real head angle of the said tool so that the "effective" head angle is maintained constant.

What we claim is:

1. Lens grinding apparatus capable of generating in a lens blank a power curve of less than three diopters and having both a base curve characteristic and a cross curve characteristic, said apparatus comprising:

base means having a lens supporting means and a tool supporting means mounted thereon, said lens supporting means comprising a tailstock mounted on said base means for movement toward and away from said tool supporting means and including means for supporting a lens blank, said tool supporting means comprising a plate pivotably mounted on said base means, first slide means slidably mounted on said plate, second slide means pivotably mounted on said first slide means, and a tool block mounted on said second slide means for rotating a cup-shaped tool about a tool axis of rotation, said plate being pivotably mounted for pivoting movement relative to said base means about an upright first axis to sweep said tool across a lens blank mounted in said lens supporting means for simultaneously cutting in the lens blank a base curve characteristic and a cross curve characteristic, said base curve characteristic being less than three diopters and having a center of curvature spaced from said first axis, said tool axis of rotation and a radius of curvature of said base curve characteristic forming therebetween an effective head angle defining said cross curve characteristic, said first slide means being slidable relative to said plate along a second axis oriented generally perpendicularly to said first axis for varying a sweep radius defined as a distance between said tool and said first axis, a sweep angle formed between said second axis and a line intersecting said first axis and a center of a lens blank, said tool axis of rotation and said second axis forming therebetween a real head angle, said second slide means being pivotably mounted on said first slide means for pivotal movement about a third axis oriented generally perpendicularly to said second axis for changing said real head angle, actuating means for sliding said first slide means relative to said plate along said second axis, and for pivoting said second slide means relative to said first slide means about said third axis, sensing means for continuously determining said sweep angle and generating a signal indicative thereof, and a micro-processor operably connected to said sensing means and said actuating means for receiving said signal and continuously calculating, as a function of both said sweep angle and said base and cross curve characteristics, a value of said sweep radius necessary to maintain said radius of curvature constant, and a value of said real head angle necessary to maintain said effective head angle constant, and operating said actuating means for continuously sliding said first slide means relative to said plate to establish said calculated sweep radius, and for continuously pivoting said second slide means relative to said first slide means about said third axis to establish said calculated real head angle.

2. Apparatus according to claim 1, wherein said actuating means comprises hydraulic cylinders.

* * * * *